US006164652A

United States Patent [19]

Lauretta et al.

[11] Patent Number: 6,164,652

[45] Date of Patent: Dec. 26, 2000

[54] MATCH THE DEALER CARD GAME

[75] Inventors: Antonio Lauretta, Cocoa Beach; Robert W. Kelly, Merritt Island; Kent G. Evans; James W. Ferguson, both of Cocoa Beach, all of Fla.

[73] Assignee: Match the Dealer, Inc., Titusville, Fla.

[21] Appl. No.: 09/241,722

[22] Filed: Feb. 2, 1999

Related U.S. Application Data

[62] Division of application No. 08/787,753, Jan. 28, 1997, Pat. No. 6,004,205.

[51] Int. Cl.[7] ..... A63F 1/00

[52] U.S. Cl. ..... 273/292; 273/273

[58] Field of Search ..... 273/292, 273; 963/12, 13

[56] References Cited

U.S. PATENT DOCUMENTS

| | | | |
|---|---|---|---|
| 4,531,187 | 7/1985 | Uhland | 364/412 |
| 4,861,041 | 8/1989 | Jones et al. | 273/292 |
| 5,159,549 | 10/1992 | Hallman, Jr. et al. | 364/412 |
| 5,265,874 | 11/1993 | Dickinson et al. | 273/138.2 |
| 5,326,104 | 7/1994 | Pease et al. | 273/138.2 |
| 5,377,973 | 1/1995 | Jones et al. | 273/292 |
| 5,393,067 | 2/1995 | Paulsen et al. | 273/292 |
| 5,470,079 | 11/1995 | LeStrange et al. | 273/138.2 |
| 5,476,259 | 12/1995 | Weingardt | 273/138.2 |
| 5,570,885 | 11/1996 | Ornstein | 463/27 |
| 5,607,162 | 3/1997 | Boylan et al. | 273/292 |
| 5,613,912 | 3/1997 | Slater | 463/25 |
| 5,762,340 | 6/1998 | Feola | 273/292 |
| 5,779,546 | 6/1998 | Meissner et al. | 463/25 |
| 5,788,574 | 8/1998 | Ornstein et al. | 463/25 |
| 6,004,205 | 12/1999 | Lauretta et al. | 463/11 |

OTHER PUBLICATIONS

Scarne's Encyclopedia of Games, John Scarne, "Ziginette", "The Skin Game", "Monte", Harper & Row Publishers, pp. 307–312, 1973.

Maverick Blackjack, May 1995.

*Primary Examiner*—Benjamin H. Layno

*Attorney, Agent, or Firm*—Brian S. Steinberger; Law Offices of Brian S. Steinberger

[57] ABSTRACT

A matching card game where players are dealt five cards apiece. Each player tries to match the cards with the dealers hand. Any matches between the players match cards and the dealers cards wins. Progressive jackpots are included with subsequent card games. An automated casino card game version monitors the tracking, and jackpots of players at gaming tables. The automated version includes a table, player LED displays on one side of the table for displaying credits available for a progressive jackpot, a dealer control panel on the opposite side of the table, and a central processing unit, the player LED displays, the dealer control panel and the central processing unit together monitoring the tracking, and jackpots of each player at the player LED displays.

20 Claims, 20 Drawing Sheets

Play Step Flowchart

Fig. 2A

"MATCH" Bet Payouts

The "MATCH" bet payouts are:

| Player Hand | Dealer Hand | Payout |
|---|---|---|
| 1 of a kind | 1 Match | 1 -1 |
| | 2 Match | 2 - 1 |
| | 3 Match | 5 - 1 |
| | 4 Match | 10 - 1 |
| 2 of a kind | 1 Match | 1 - 1 |
| | 2 Match | 5 - 1 |
| | 3 Match | 10 - 1 |
| 3 of a kind | 1 Match | 5 - 1 |
| | 2 Match | 10 - 1 |

Fig. 2B

"MATCH" Bet Payouts

I. PLAYER HAND ONLY = Four of a kind, Winner.
No match required.
Payout = 10 - 1

II. PLAYER HAND ONLY = Five of a kind, Winner.
Ace thru 10.
Payout = 20 - 1

Fig. 3A

"MATCH" Pot Payouts *

I. Based on TOTAL MATCHING CARDS between each player and the dealer's hand.

| | | |
|---|---|---|
| (5) Matching | = | $50.00 |

II. Based on player hand only.

| | | |
|---|---|---|
| (5) Aces | = | 100% of "MATCH" Pot |
| Five of a kind 2-10 | = | $10,000.00 |
| Four of a kind | = | $100.00 |

III. Best Player hand of the month will receive 25% of the accumulated Jackpot at the end of each cycle. Figure 3B shows the priority of each hand for this Payout. In the event of a tie(s), the 25% will be distributed evenly among the winners.

* Requires participation in the Progressive "Match" Pot.

Figure 3B

The best hand of the MONTH which will receive 25% of the accumulated jackpot at the end of each 30 day cycle will be determined by the following schedule. *Only hands dealt to Players participating in the "Match" Pot are eligible.*

Definition of "best hand of the MONTH":
The cycle for this payment is 30 days. The cycle will begin when the first game is dealt and will end at 12:00 noon local time on day 30. In the event a game is in process at that time then the cycle will end at the completion of that hand. In the event a Player only hand of the five aces is dealt to a Player who is participating in the jackpot then the cycle will end and a new 30 day cycle will begin with the next game dealt.

1. Player hand only = Five of a Kind 2-10
2. Any combination of 5 matching card between the individual Player and the Dealer hands.
3. Player hand only = Four of a kind.
4. Any combination of Four matching cards between the individual Player and the Dealer hands.
5. *Any combination of Three matching cards between the individual Player and the Dealer hands.*
6. *Any combination of Two matching cards between the individual Player and the Dealer hands.*

LED 1 shows if player is included in current progressive bet.

LED 2 shows if player is excluded in current progressive bet.

Functional Flow Diagram Match the Dealer.

Functional Flow Diagram Match the Dealer.

MATCH THE DEALER CARD GAME

This is a Divisional of Application Ser. No. 08/787,753 filed Jan. 28, 1997, now issued as U.S. Pat. No. 6,004,205.

This invention relates to gaming tables, in particular to a game played at multiple table units clustered about a central processing unit where tracking, jackpots, and wagering status are monitored.

BACKGROUND AND PRIOR ART

Gambling has become very popular in recent years as shown by the number of states having legalized landbased casino gambling such as Las Vegas and Reno, Nev.; Atlantic City, N.J., and New Orleans, La. Riverboat gambling has also become popular and is in several states including Mississippi, Mo. and Illinois. Most forms of gambling center around automated slot machines, roulette wheels, dice, or card games such as poker and blackjack played on the tables on the casino floors.

Card games used in gambling are traditionally limited to blackjack, poker, and the like. While the rules for versions of these games may vary, almost no new card games are ever created for players.

These traditional card games are generally controlled manually by having a dealer pass out cards to players seated around a table, where the dealer manually controls the wagering and jackpot payouts. Attempts have been made to automate aspects of these card games. See for example: U.S. Pat. Nos.: 4,531,187 to Uhland; 5,159,549 to Hallman, Jr. et al.; 5,265,874 to Dickinson; 5,326,104 to Pease et al.: 5,377,973 to Jones et al.; 5,393,067 to Paulsen et al.; 5,470,079 to LeStrange et al.; and 5,476,259 to Weingardt. However, these devices and systems generally are complex and expensive and still do not allow for monitoring from a central point the tracking, jackpots, and wagering status of the games.

SUMMARY OF THE INVENTION

The first objective of the present invention is to provide an electronic method for determining each Players' status relative to participation in a progressive jackpot.

The second objective of the present invention is to provide a central processing system for calculating and displaying the actual value of the progressive jackpot on a real time basis.

The third objective of the present invention is to provide a novel card game in which a deck of 50 cards, all the same suit, consisting of five each Ace, 2, 3, 4, 5, 6, 7, 8, 10 is dealt one by one to each Player and the Dealer, face down, until each hand has five cards. No card is superior.

The fourth objective of this invention is to provide a novel gambling card game wherein the Player(s) wins if one or more of the cards in the Player selected "MATCH" hand is matched by one or more cards in the Dealer hand. Each Player hand is independent.

The fifth objective of the present invention is to provide a simple, non-intimidating table card game for the recreational player with the opportunity to win substantial cash payouts by participating in the Progressive Jackpot.

Further objects and advantages of this invention will be apparent from the following detailed description of a presently preferred embodiment which is illustrated schematically in the accompanying drawings.

BRIEF DESCRIPTION OF THE FIGURES

FIG. 2A is a chart representing the "MATCH" bet payouts when a player's hands has a match with the dealer's hands.

FIG. 2B shows the PLAYER HAND ONLY payouts without having to "MATCH" a dealer's hand.

FIG. 3A shows exemplary "MATCH" Pot Payouts.

FIG. 3B shows priority of hands for 25% of Jackpot payout.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

The novel invention includes a card game entitled: MATCH THE DEALER™. The game centers around a dealer and one to seven players at a table. A single suit deck of 50 cards is used having five of each card from Ace, 2, 3, 4, 5, 6, 7, 8, 9, and 10. For the rules, each player and the dealer received five cards face down. Each player's hand stands on its own. The dealer hand is for MATCH purposes only. None of the cards is superior to the other cards. The object of the game is for each player to select from their dealt hand either a single card, two of a kind, or three of a kind as the "MATCH" hand. The player wins if the dealer's hand has one or more cards that match the player "MATCH" hand.

For example, a player can have a five card hand of: Ace, two, four, seven, nine. The player can select any card, pair, or three of a kind as the "MATCH" hand. A dealer can have a hand of: Ace, three, five, seven and ten. If the player had used the Ace or seven as the "MATCH" hand there would be a MATCH and the player wins.

Figure 1:
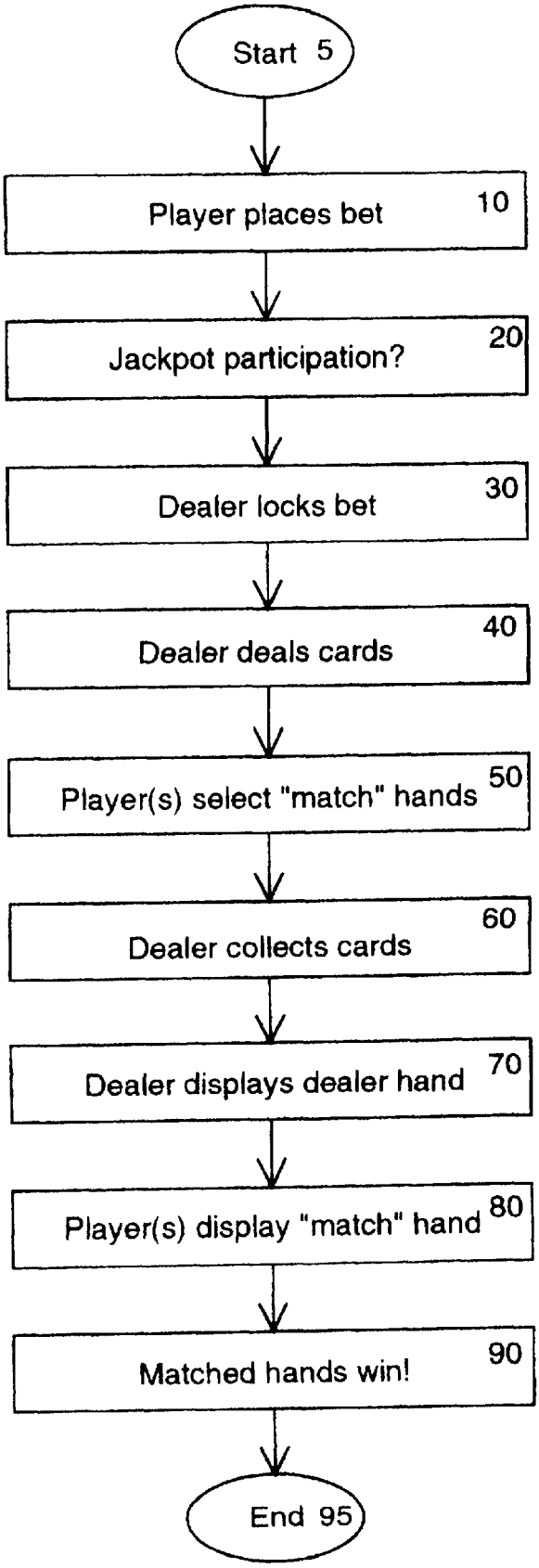
FIG. 1 is a flow chart showing the steps in order to play the "Match the Dealer" invention.

FIG. 1 is a flow chart showing the nine steps in order to play the "Match the Dealer" invention. Referring to FIG. 1, a game stars 5, with a deck of 50 cards, where there are five each of Ace, 2, 3, 4, 5, 6, 7, 8, 9 and 10. All cards are the same suit. In step 10, a player placed bet in the "MATCH" circle in front of each player. A minimum bet can be $5.00.

In step 20, a player elects participation in a Progressive Jackpot by purchasing credits from the Dealer. The value of each credit can be $1.00 and can be purchased in any increment. For example, five can be a common amount. Entry into a game is one credit or $1.00. These credits are then displayed electronically in the digital read out in front of each Player station, which is described in greater detail in reference to FIG. 5 and 7. In step 30 a dealer locks in the progressive bets by electronically deducting one credit from each participating Player. In step 40 the dealer gives each Player and the Dealer five cards face down. In step 50, each Player selects the "MATCH" hand from their five cards. The "MATCH" hand can be a single card, a pair of the same cards, or three of the same cards. The "MATCH" hand is placed face down in the "MATCH BOX" so labeled in front of each Player. The remaining cards are placed face down in the discard area in front of each Player. In step 60, the dealer collects the discards. In step 70, the dealer displays the dealer hand. In step 80, the players display their "MATCH" hands. In step 90, players with cards in their "MATCH BOX" which are matched by one or more of the cards in the Dealer hand win and are paid according to FIG. 2A. The game ends 95, and further hands are dealt by repeating steps 10–90.

FIG. 2A is a chart representing the "MATCH" bet payouts when a player's hands has a match with the dealer's hands for one, two and three of a kind. FIG. 2B shows the PLAYER HAND ONLY payouts without having to "MATCH" a dealer's hand for: I. four of a kind, and II. five of a kind.

FIG. 3A shows exemplary "MATCH" Pot Payouts. Under scenario I, based on TOTAL MATCHING CARDS between each player and the dealer's hand, five(5) total matching cards is equal to $50.00. Under scenario II, based on a player hand only of five(5) aces, the pot payout is 100% of the "MATCH" Pot. Based on a player hand only of Five of a kind (from cards 2–10), payout is $10,000.00 Any four of a kind cards on a player hand only, the payout is $100.00. Under scenario III, the best hand of the month can receive 25% of the accumulated Jackpot at the end of each cycle.

FIG. 3B shows the priority of each hands for 25% of the Jackpot payout. In the event of a tie(s), the 25% can be distributed evenly among the winners. Four scenarios cover the best hand. Under scenario I, a player hand only can be five of a kind (any of the cards 2–10). Under scenario II of the best hand, any combination of 5 matching cards between the individual player and the dealer hands. Under scenario III of the best hand, the player hand only can be be four of a kind. Under scenario IV of the best hand, any combination of four matching cards between the individual player and the dealer hands.

Figure 4:
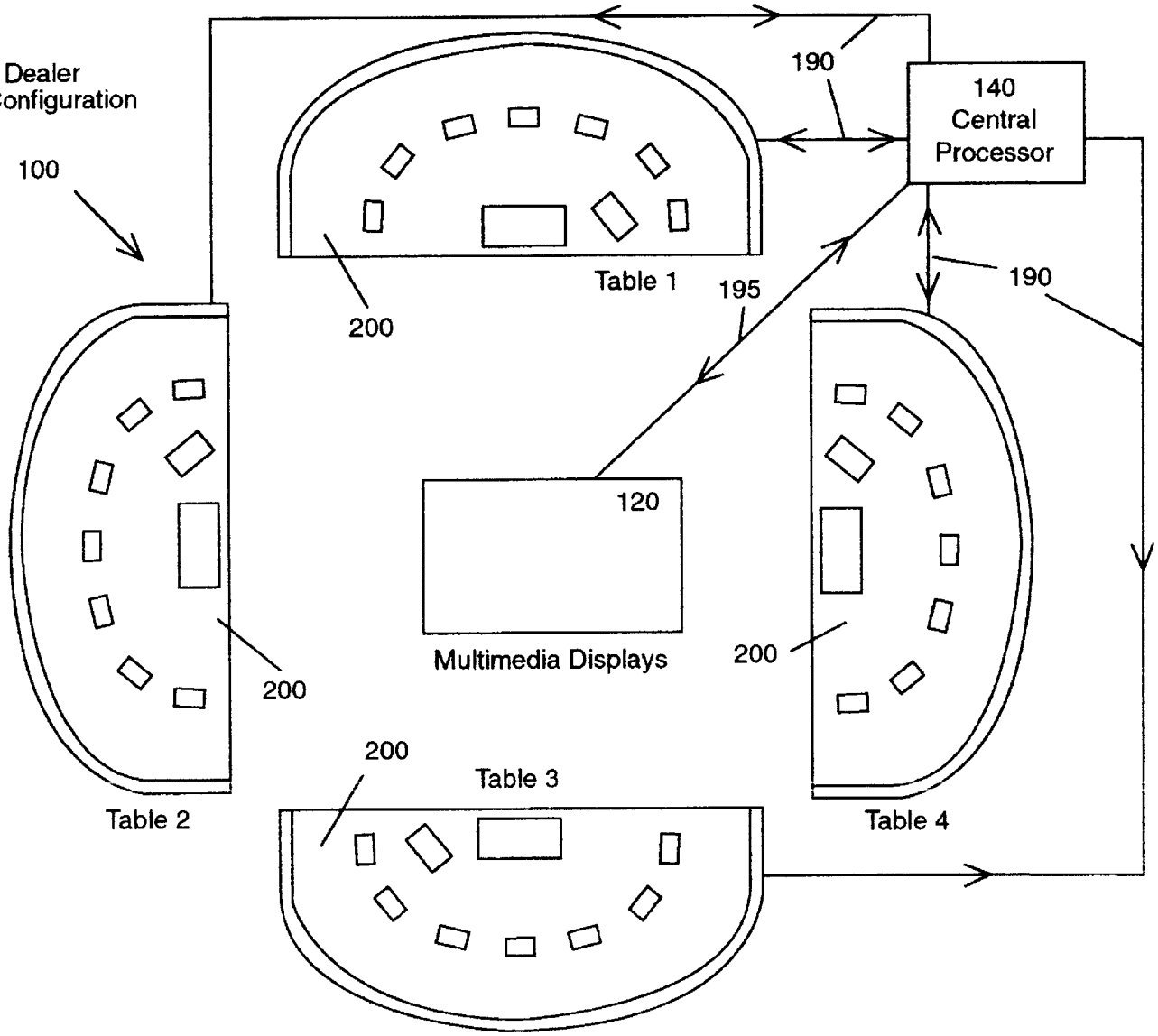
FIG. 4 is a top view showing a cluster arrangement of four tables arranged in a cluster connected to a central processing node.

FIG. 4 is a top view showing a cluster arrangement 100 of four tables 200 arranged in a cluster around multimedia displays 120 connected to a central processing node 140. Multi media displays 120 are computer driven displays consisting of prerecorded digital images, video sequences and/or real time displays updated by table inputs. The type of information that will be displayed is the progressive jackpot totals, marketing graphics, game play rules, and payoff odds. Displays 120 can be standard television monitors such as but not limited to 26", 32" Panasonic Television monitors, RGB video monitors, digital signs, digital flat screen displays, and the like. The central processor node 140 can be an IBM based 586 equipped with a CD ROM drive, a sound board with audio outputs and an interface board capable of handling the serial data interfaces RS-485, and the like, that connect the tables 200 to the CPU 140. Tables 200 interface the CPU 140 over a serial data interface line 195 such as an RS-485, and the like. Data such as progressive bet summary data, win status along with payoff data for the progressive jackpot flows from the tables 200 to CPU 140. This data can be used to update the progressive summary displays and for compilation of statistical information relating to game performance.

Figure 5:
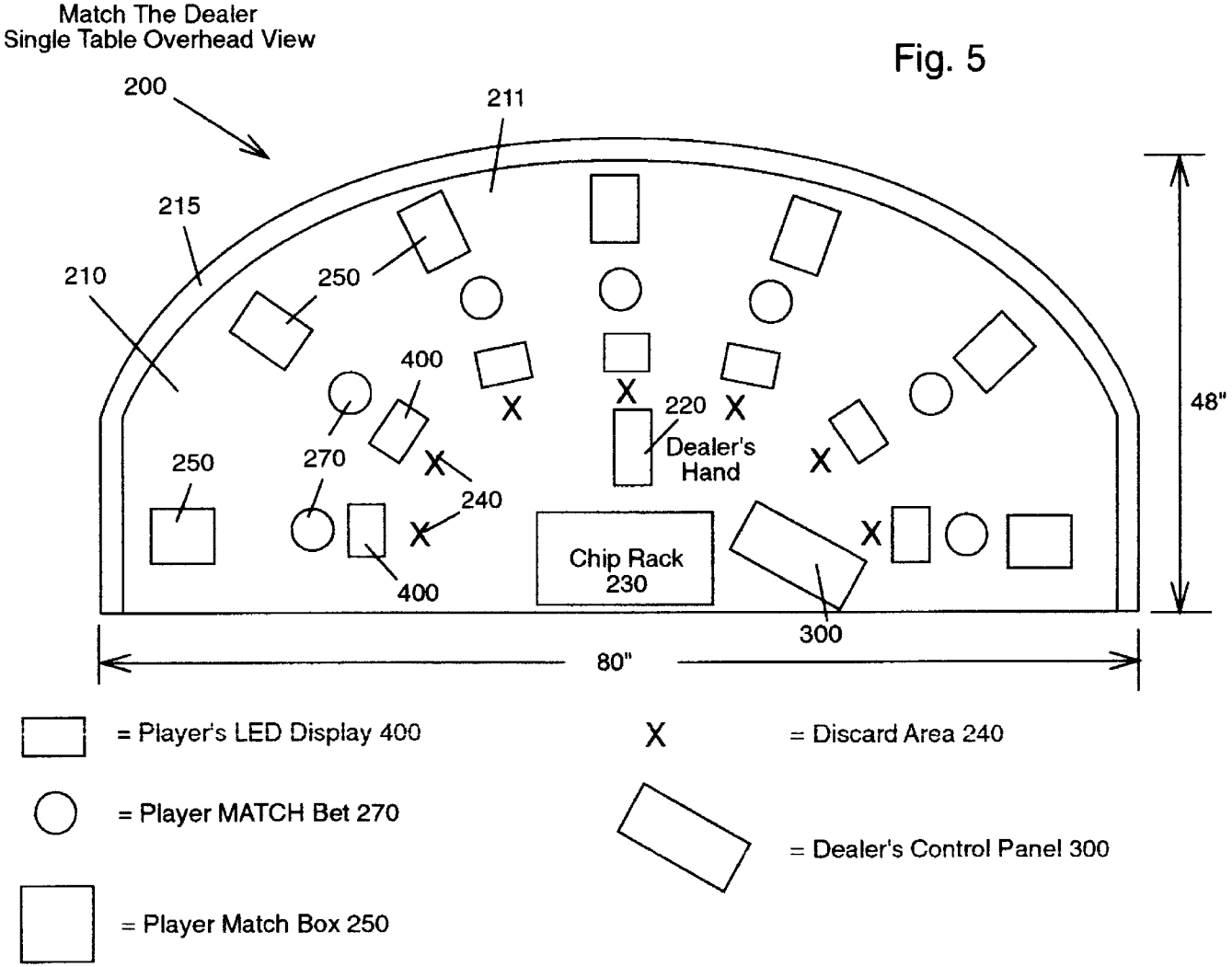
FIG. 5 is a top view of a single player table used in FIG. 4.

FIG. 5 is a top view 200 of a single player table used in FIG. 4. Table 200 includes a half-round or crescent shape 210 with an overall length, L1, of approximately 86 inches and a width, W1, of approximately 36 inches. The top 210 can be constructed from material such as but not limited to plywood, composite material having a top playing surface 211 finished with a standard card playing felt material. Table 200 can have a padded elbow support rail 215 on the curved player side. Table 200 can have a height above ground level of approximately 42 inches. In front of the rail 215 are player match boxes 250, player match bet areas 270, player displays 400 (shown in greater detail in reference to FIG. 7), discard area X, 240, dealer hand spot 220, a chip storage rack 230 to support betting chips, and a dealer operates a dealer control input panel 300 (shown and described in greater detail in reference to FIG. 6).

Figure 6:
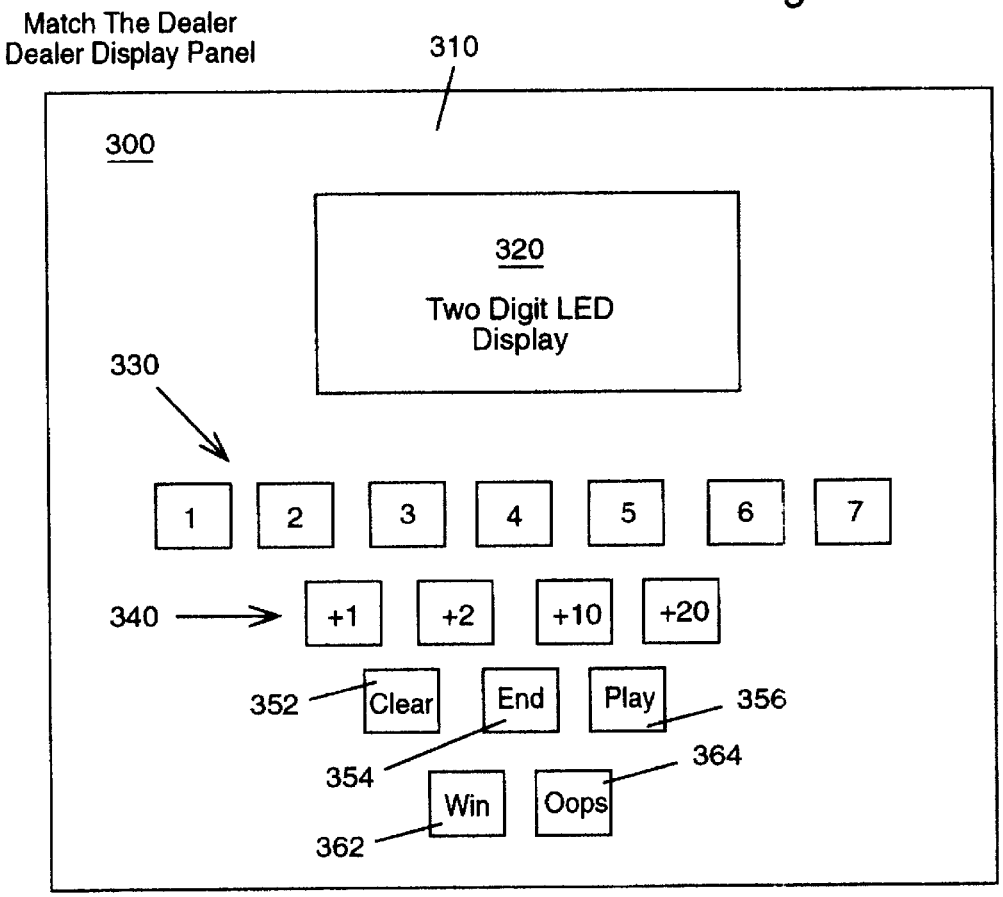
FIG. 6 is a top view of a dealer control input and display panel for use with the table of FIG. 5.

FIG. 6 is a top view of the electronic dealer control input and display panel 300 for use with the table of FIG. 5. Dealer display panel 300 includes back panel 310, a two digit LED display 320, numerical input keypad 330, with the numeral 1–7. Display 320 can be used to display the contents of any of the play registers, during credit purchasing or cash out operations by the dealer. Depressible LED lighted push buttons 330, 340, 352, 354, 356, 362, 364 will now be described. Buttons 330 are used to select which player position the dealer is viewing on the dealer display 320. Buttons 340 are used for entry of credit values of 1–99 for transfer to the player displays. Button 352 is used to zero the dealer register for cashout operations. Button 354 is used to lockout the dealer keypad operations prior to execution of a hand. Buttons 356 is used to decrement all active player registers immediately prior to execution of a hand of play. Button 362 is used to indicate to the CPU that a player hand has won the progressive jackpot. Button 364 is used to back up the sequence of keypad's entry's 1 step.

The operation of display 300 of FIG. 6 will now be described. For the dealer to credit player one with 23 progressive credits and execute on hand of play, the following steps can be followed. First, player one would request 23 credits from the dealer and pay the dealer 23 dollars. Next, the dealer would depress the "1" button in the 330 row of buttons. An LED in button labelled "1" would light and display would indicate any credits already residing in player one's total. Next, the dealer would depress the +1, +2 and the +20 pushbuttons labelled 340. The dealer display 320 LED would indicate the total of 23 plus the original value in the player one register. The dealer would then press the "1" button in the 330 row of push buttons to transfer the dealer register contents to the player one display. The dealer would then press the End 354 button to lockout any other dealer data operations. The dealer would then depress the Play 356 button that decrements all active player registers. The hand is then dealt and play is commenced.

Figure 7:
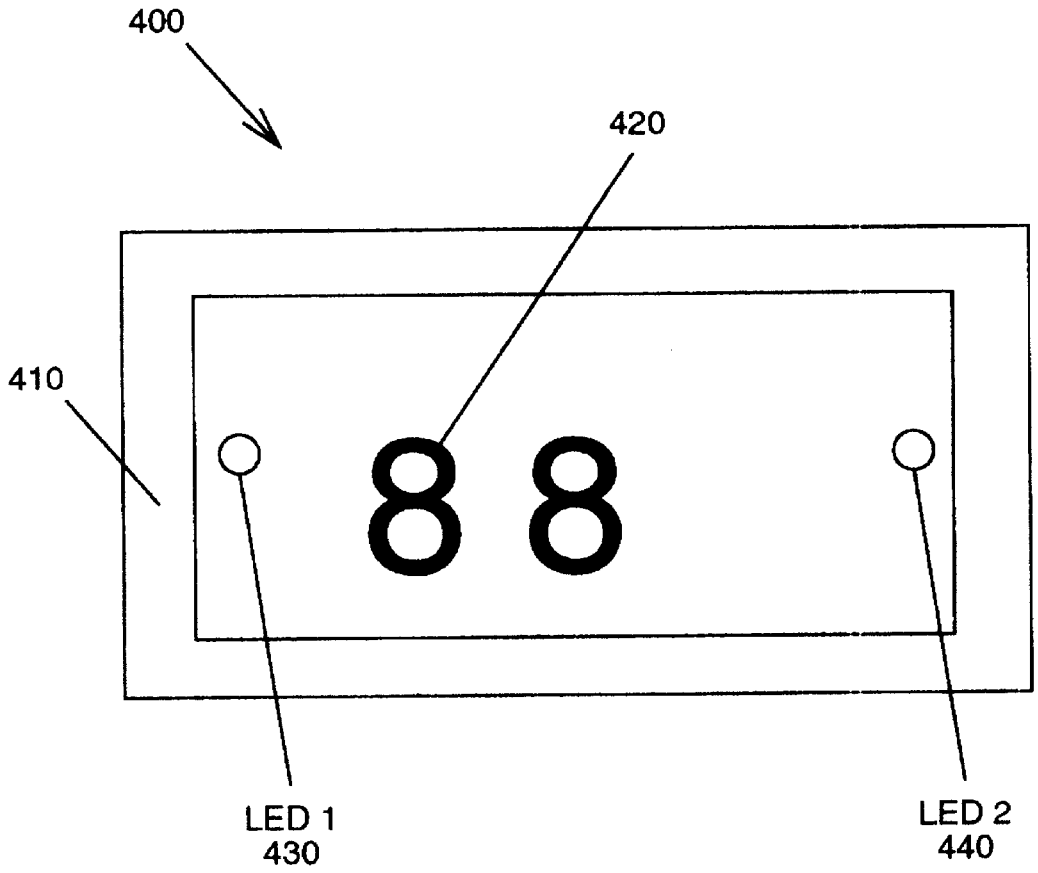
FIG. 7 is a top view of a player display panel for use with the table of FIG. 5

FIG. 7 is a top view of a player display panel 400 for use with the table 200 of FIG. 5. Player display panel 400 includes a mounting frame 410, and LED numerical display 420. Player display 420 indicates the players progressive credits available for inclusion in the progressive. The LED's 1 and 2 are to indicate if a player is included in the progressive bet for the hand currently in play. A left red LED light 1, 430, shows if the player is included in the current progressive bet. A right LED green light 2, 440, shows if the player is excluded in the current progressive bet.

Figure 8A:
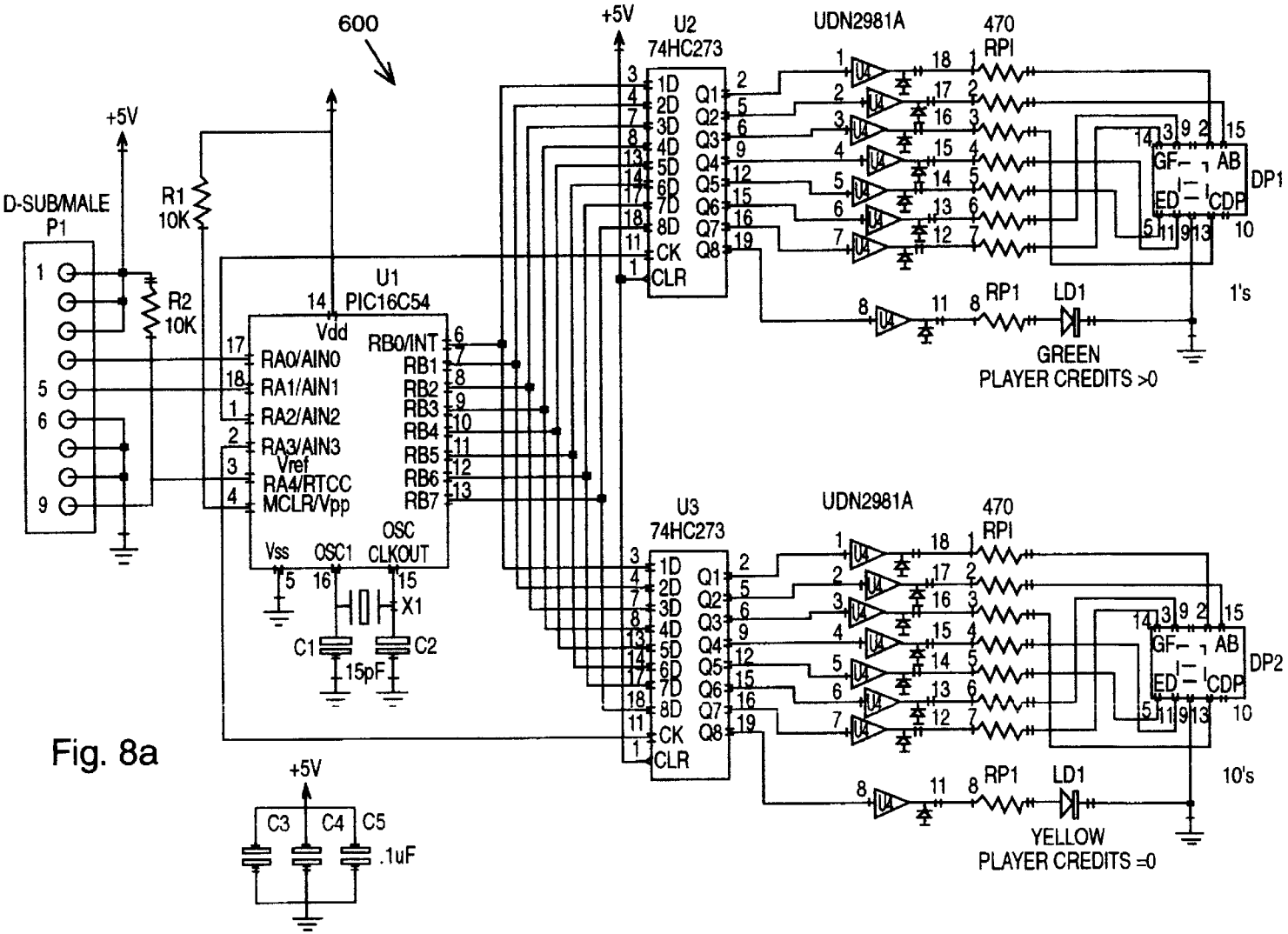
FIG. 8*a* is a schematic of the display board circuitry of the player display panel.
Figure 8B:
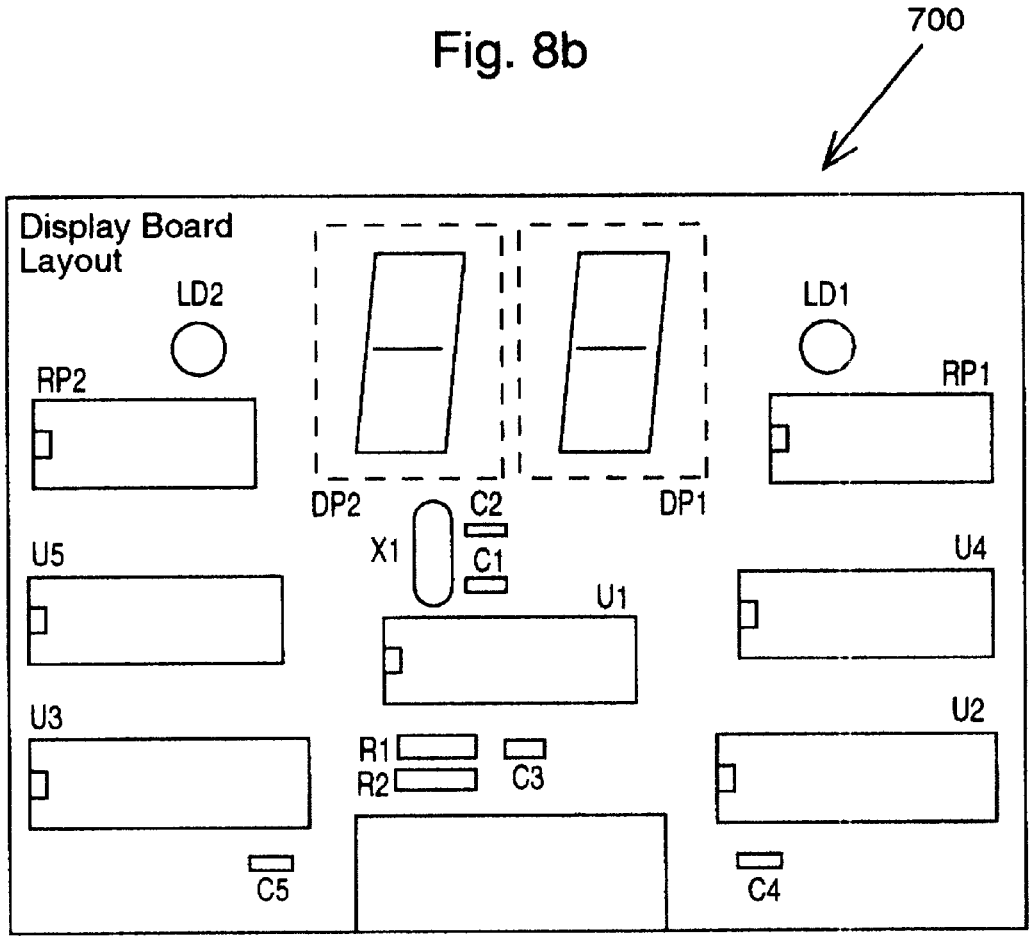
FIG. 8*b* is a display board layout of the schematic of FIG. 8*a*.
Figure 9A:
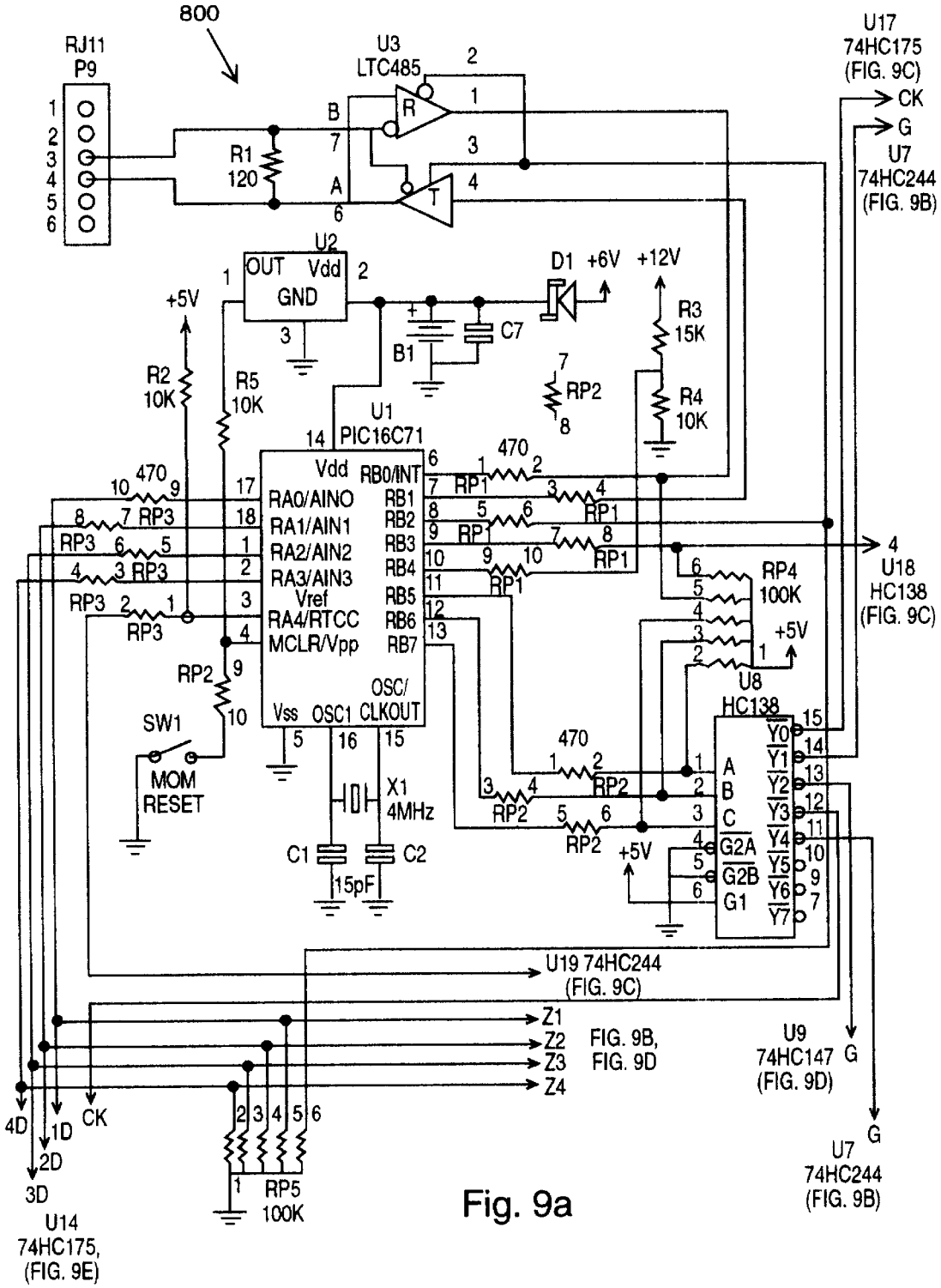
FIGS. 9*a*, 9*b*, 9*c*, 9*d*, 9*e*, 9*f*, 9*g*, and 9*h* is a schematic of the table interface board circuitry used in the preferred embodiment of the Match the Dealer invention.
Figure 9B:
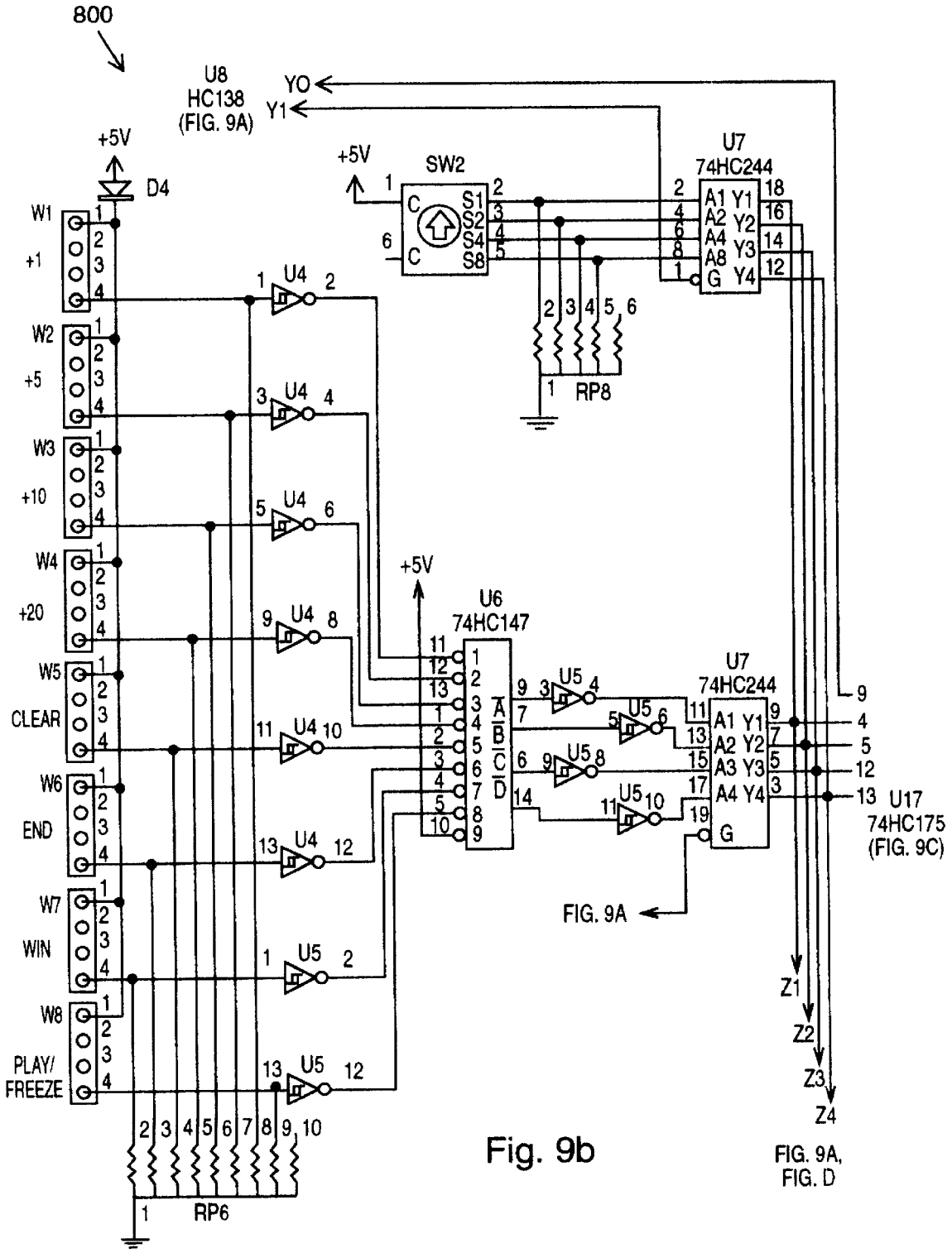
Figure 9C:
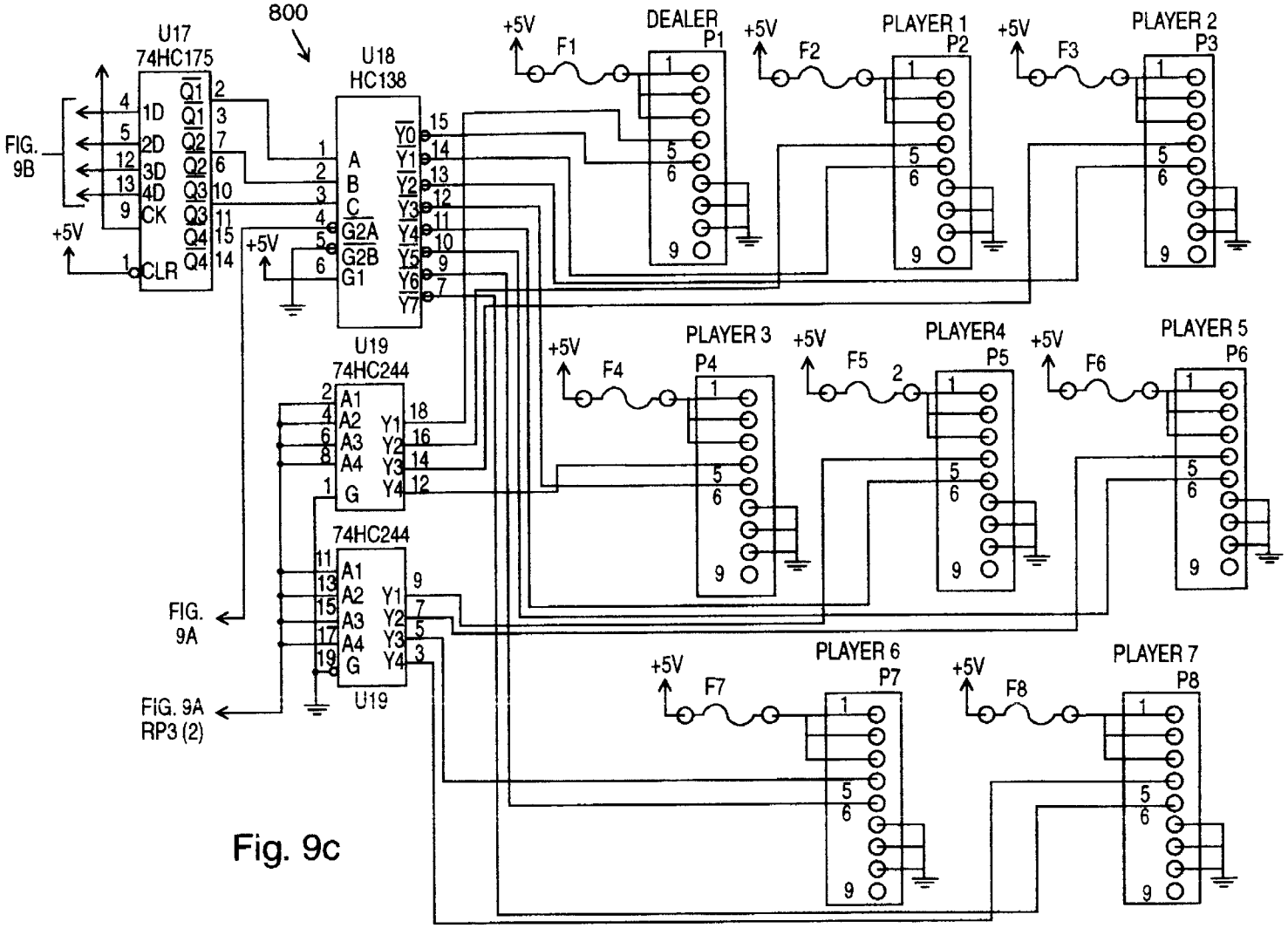
Figure 9D:
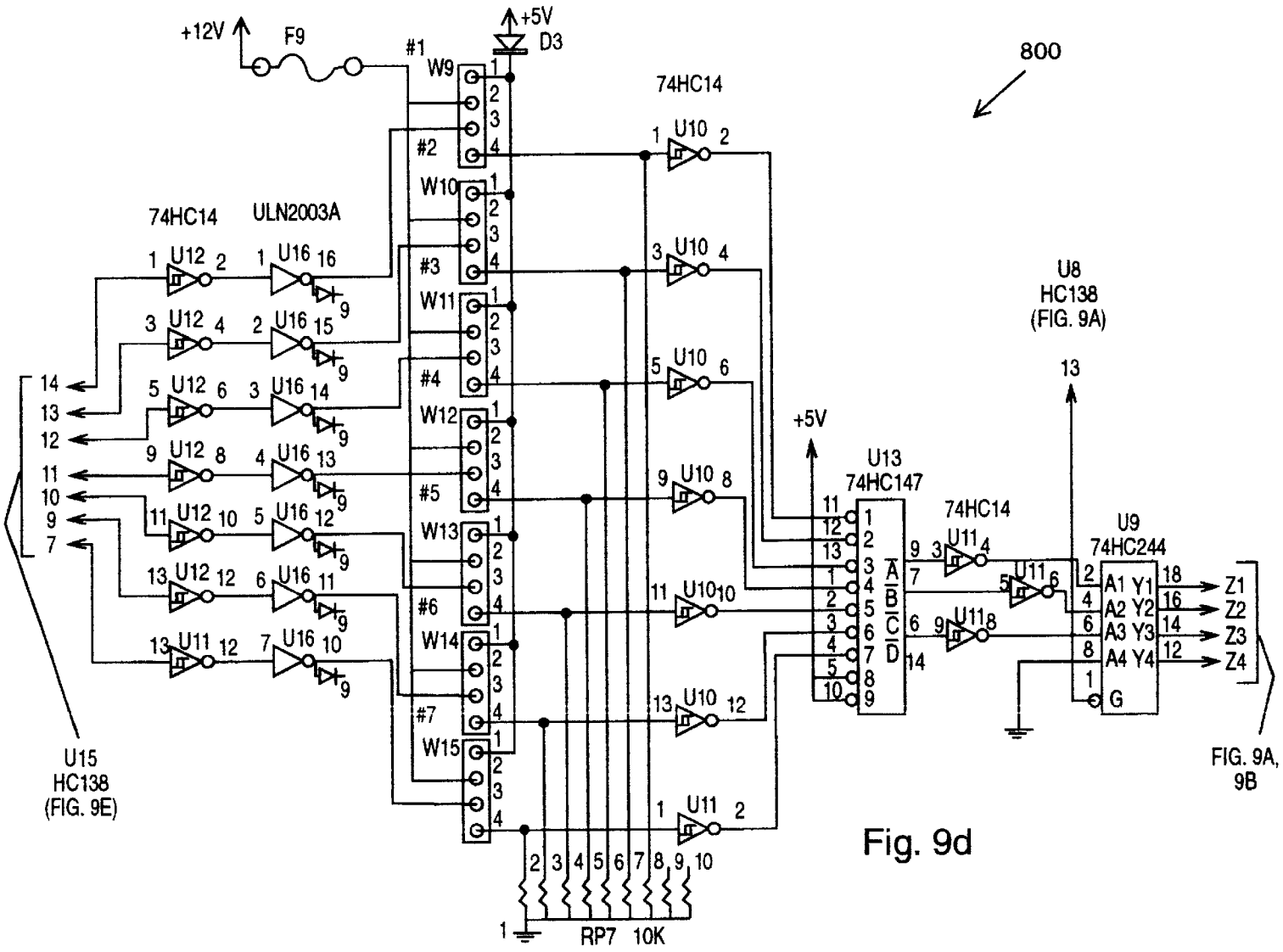
Figures 9E, 9F, 9G, 9H:
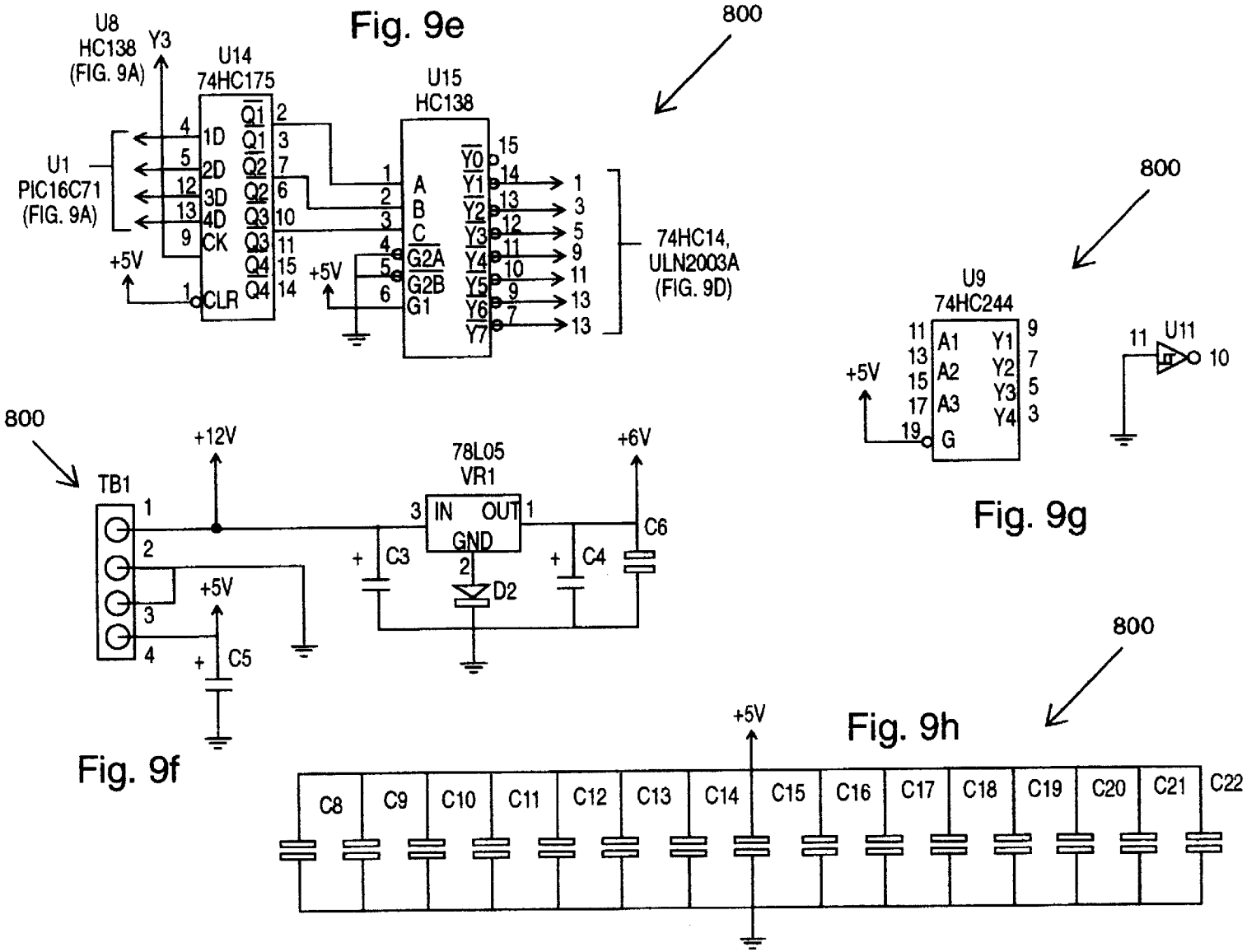
Figure 10:
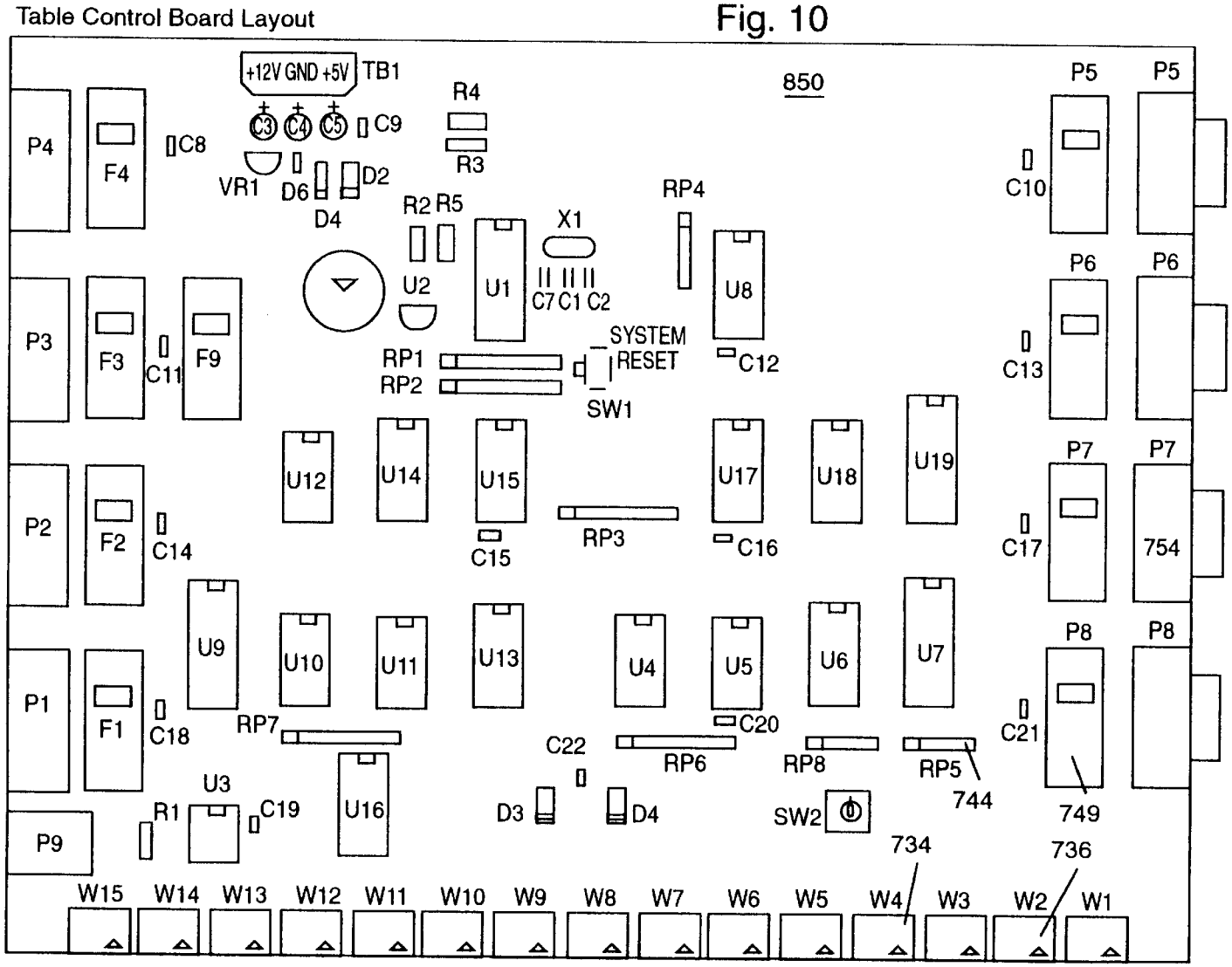
FIG. 10 is a table control board layout of the schematic of FIG. 9

FIG. 8*a* is a schematic 600 of the display board circuitry. FIG. 8*b* is a display board layout 700 of the schematic of FIG. 8*a*. FIGS. 9*a*–9*h* is a schematic 800 of the table interface board circuitry used in the preferred embodiment of the Match the Dealer invention. FIG. 10 is a table control board layout 850 of the schematic of FIGS. 9*a*–9*h*. Table 1 is a listing breakdown of the electrical components of FIGS. 8*a*, 8*b*, 9 and 10.

TABLE 1

| QTY. | | | |
|---|---|---|---|
| | 8 | P1-P8 | CONNECTOR, D-SUB, 9 PIN, MALE |
| | 9 | F1-F9 | CIRCUIT BREAKER, .4 AMP |
| | 1 | P9 | CONNECTOR, RJ11 5 PIN |
| | 1 | TB1 | CONNECTOR, POWER, 4 PIN |
| | 15 | W1 · W15 | CONNECTOR, SWITCH 4 PIN |
| | 2 | C1, C2 | CAPACITOR, CERAMIC, 15cF, .1" |
| | 3 | C3, C4, C5 | CAPACITOR, TANTALUM, 10uF, 25V |
| | 17 | C6–C22 | CAPACITOR, CERAMIC, 1uF, .1" |
| | 1 | R1 | RESISTOR, 1/4w, 120, 4" |
| | 3 | R2, R4, R5 | RESISTOR, 1/4W, 10k, 4" |
| | 1 | R3 | RESISTOR, 1/4W, 15K, 4" |
| | 1 | D1 | DIODE, SCHOTTKEY, 1N5818, .4" |
| | 1 | D2 | DIODE, SMALL SIGNAL, 1N4148, .4" |
| | 2 | D3, D4 | DIODE, 1N4001, 50V, .4" |
| | 3 | RP1, RP2, RP3 | RESISTOR PACK, 470, 10 PIN ISO |
| | 3 | RP4, RP5, RP3 | RESISTOR PACK, 100K, 6 PIN BUSS |
| | 2 | RP5, RP7 | RESISTOR PACK, 10K, 10 PIN BUSS |
| | 1 | B1 | SUPER CAP, 22F, 5.5V |
| | 1 | X1 | CRYSTAL, 4 MHz |
| | 1 | VR1 | VOLTAGE REGULATOR, 5V, 7BL05 |
| | 1 | U1 | SOCKET, 18 PIN, DUAL WIPE |
| | 1 | U1 | IC, PIC16C71, MICROCONTROLLER |
| | 1 | U2 | IC, VOLTAGE DETECTOR, 2.5V |
| | 1 | U3 | IC, RS485 DRIVER, LTC485 |
| | 5 | UR, U5, U10, U11, U12 | IC, SCHMIT HEX INVERTER |
| | 2 | U6, U13 | IC, 10 TO 4 ENCODER, 74HC147 |
| | 3 | U7, U9, U19 | IC, OCTAL TRI STATE BUFFER, 74HC244 |
| | 3 | U8, U15, U18 | IC, 3 TO 8 LINE DECODER, 74HC138 |
| | 2 | U14, U17 | IC, QUAD LATCH, 74HC175 |
| | 1 | U16 | IC, DRIVER, ULN2003 |
| | 1 | SW1 | SWITCH, SPST, MOM |
| | 1 | SW2 | SWITCH, 0–9 BCD, ROTORY |
| | 1 | | CIRCUIT BOARD, 8858-2 |
| | 1 | P1 | CONNECTOR, D-SUB, 9 PIN MALE |
| | 2 | R1, R2 | RESISTOR, 1/4W, 10K, 5%, .4" |
| | 2 | C1, C2 | CAPACITOR CERAMIC, 15oF, .1" |
| | 3 | C3, C4, C5 | CAPACITOR, CERAMIC, .1uF., 1" |
| | 1 | X1 | CRYSTAL 4MHz |
| | 2 | RP1, RP2 | RESISTOR NETWORK, 479 ISO, 16 PIN DIP |
| | 1 | U1 | SOCKET, 18 PIN DIP, DUAL WIPE |
| | 1 | U1 | IC, PIC:6C54 MICRO CONTROLLER |
| | 2 | U2, U3 | IC, OCTALLATCH, 74HC273 |
| | 2 | U4, U5 | IC, OCTAL DRIVER, UDN2981A |
| 1 | 1 | LD1 | LED, GREEN |
| 1 | 1 | LD2 | LED, RED |
| 1 | 2 | DP1, DP2 | DISPLAY 7 SEGMENT |
| | 1 | | CIRCUIT BOARD, J858-1 |
| | 1 | CABINET | POWER SUPPLY, +5V@3A, +12V@2A, −12V@3A |
| | 7 | CABINET | CABLE 2 METER 9 PIN D-SUB, FEMALE TO FEMALE |
| | 1 | CABINET | POWER CABLE POWER SUPPLY TO INTERFACE 8D |
| | 1 | CABINET | CABLE, RS485 |

Figure 11A:
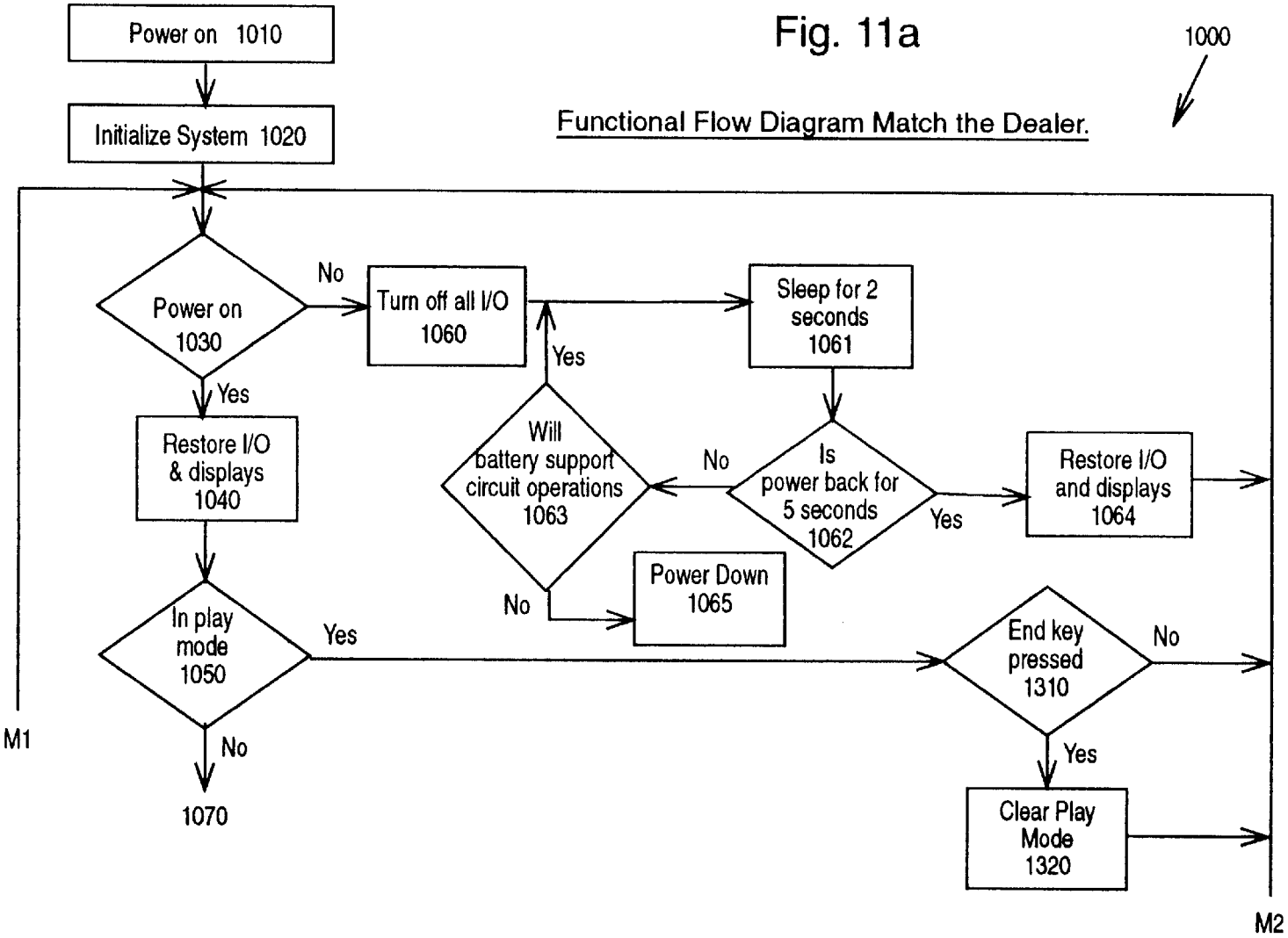
FIGS. 11*a*–11*b* is a flow chart of the tables, and CPU operation of Match the Dealer.
Figure 11B:
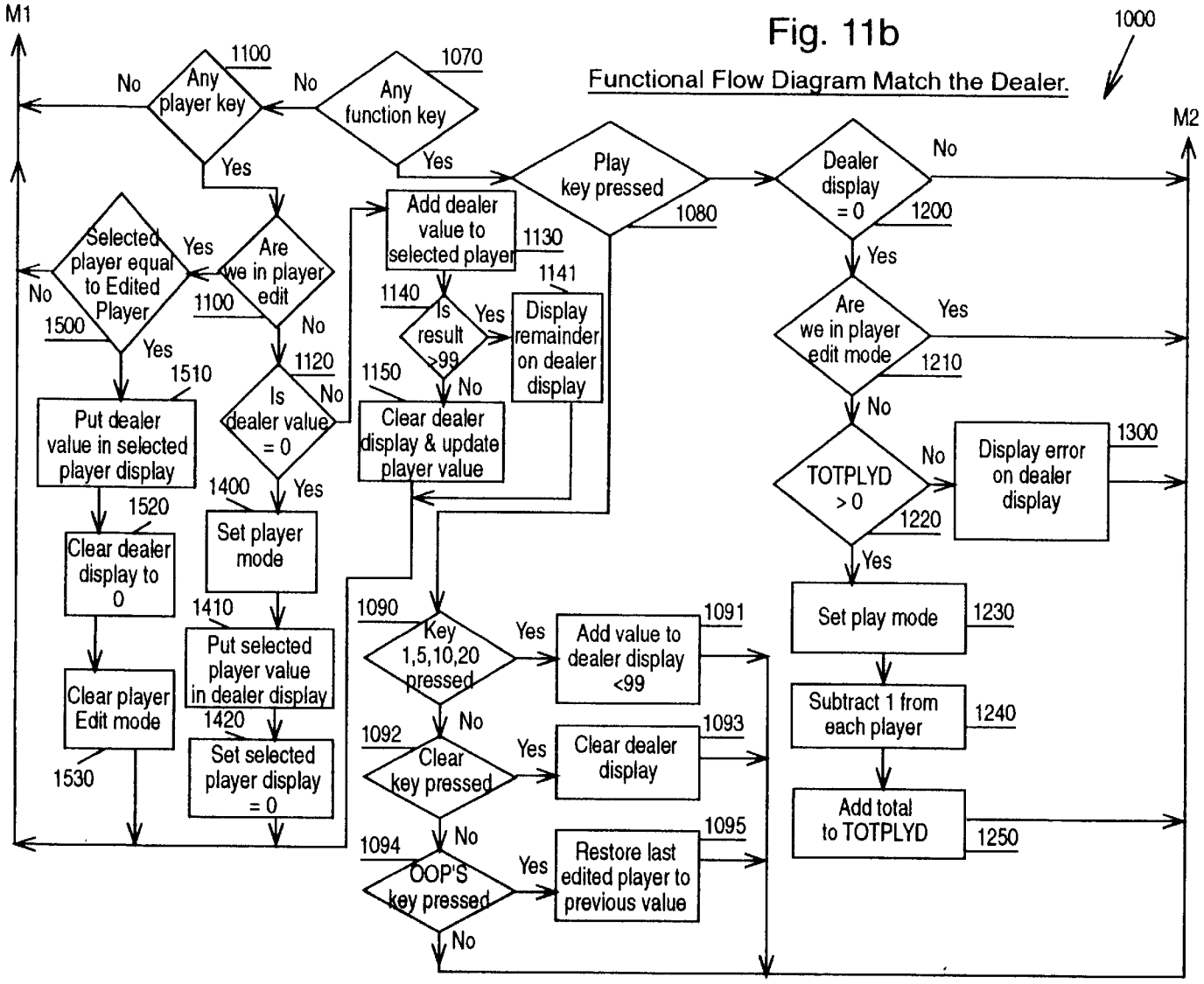

FIGS. 11*a*–11*b* is a flow chart 1000 of the tables, and CPU operation of Match the Dealer. The following functional flow will power up the system and credit player three(3) with 1 progressive credit using the dealer display panel of FIG. 6. The play mode will be entered and the single credit will be subtracted from player 3 leaving no more players with progressive credits on the table. This scenario is for functional logic flow analysis only and does not include all possible logic paths through the system. At 1010, system if powered on. At 1020 system is initialized. At 1030, a power check is completed and corrected. At 1040, input, output and displays are initialized with current register values (in this example all are 0). At 1050 is the system in Play mode? No at 1070 has any function key been pressed? Yes, at 1080 has the play key been pressed? No, at 1090 has the 1,5,10 or 20 key been pressed? Yes, the 1 key. At 1091 add the value 1 to the dealer display. At 1100, the player 3 key is pressed and the logic branches at any player key block with a yes condition. At 1110 are we in the player edit mode? No at 1120 is dealer Value equal to 0? No, at 1130 add dealer value to selected player. At 1140 is result greater than 99? No, at 1150 transfer value to player display and clear dealer display. Logic branches at the in Play mode decision block. At 1150 is the table in the Play mode? No, the Play pushbutton is pressed. At 1070 any function key? Yes at 1080 is the Play key pressed? Yes at 1200 is the dealer display equal to 0? Yes at 1210 are we in player edit mode? No at 1220 is TOTPLYD greater than 0? Yes at 1230 set play mode. At 1240 subtract 1 from each player. At 1250 add total to TOTPLYD. At this point all the player registers are zero and the TOTPLYD register is equal to 1. Boxes 1060–1065 represent that shutting down of the main power supply (such as a 120 volt house supply) to the system eventually causes the battery 1063 to run out and power down 1065 where the system 1000 is no longer operational. Applying main power supply on at 1030 or turning on the power supply on within 5 seconds at 1062 restored input output and displays of 1040, 1064.

Figure 12:
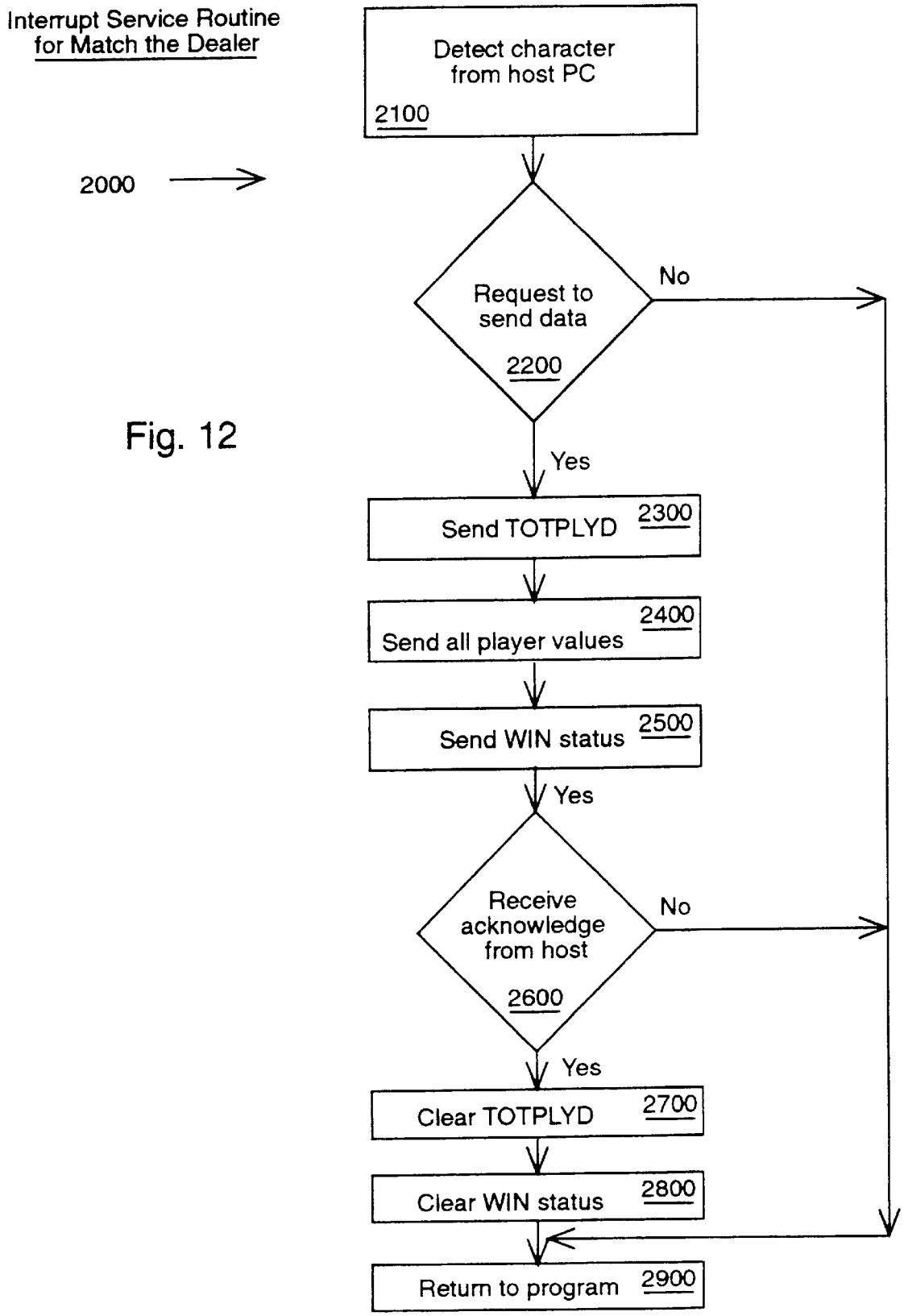
FIG. 12 is a flow chart of the interrupt service routine for the Match the Dealer data communication link from the table to the CPU.

FIG. 12 is a flow chart 2000 of the interrupt service routine for the Match the Dealer data communication link from the tables to the CPU which were represented in FIG. 4. Referring to FIG. 12, at 2100 the host PC signals that it is ready to receive data from a table. At 2200 the table detects a request to send data from the host PC. At 2300 the value stored in TOTPLYD is sent to the PC. At 2400 the value stored in each of the seven player registers is sent to the PC. At 2500 the status of the WIN bit(ON or OFF) is sent to the PC. At 2600 the PC sends an acknowledge to the table. If the table does not receive the acknowledgement then the TOTPLYD and WIN values are not cleared and the routine is exited. If the table does receive an acknowledge then the data transmission was successful and the TOTPLYD register is cleared at 2700. If the WIN status is set then it is cleared at 2800. The program return's to normal program execution occurs at 2900.

The tracking status generated tracks actual dollar input into the progressive "Match Pot."

While the preferred embodiment is described for use with gaming tables connected to a multimedia display and a central processor, the invention can be used in a Video game version such as those found in the video poker games manufactured by Balleys and IGT.

Although the preferred embodiment described using the "MATCH THE DEALER" card game on the tables and central processing unit, other types of card games such as but not limited to blackjack, and the like can be used.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A method of playing a matching card game between a dealer and at least one player comprising the steps of:

(a) selecting a deck of cards, said deck of cards comprising a plurality of cards each having a face value, said deck having cards of different face values wherein there are at least two same face value cards for each face value;

(b) initially dealing a hand of five cards to each player and to the dealer; and (c) selecting a card or a plurality of same face value cards in each player hand in an attempt to match the face value of the player selected card or cards with face value of a card or plurality of same face value cards in the dealer's hand;

(d) comparing the face value of said player selected card or cards with the face value of a card or cards in the dealer's hand, wherein the each player having any match wins the matching card game.

2. The method of playing the matching card game of claim 1, wherein the deck further includes:

card having a face value limited to: Ace, 2, 3, 4, 5, 6, 7, 8, 9 and 10.

3. The method of playing the matching card game of claim 2, wherein the face value cards include:

five Ace cards, five number two cards, five number three cards, five number four cards, five number five cards, five number six cards, five number seven cards, five number eight cards, and five number nine cards and five number ten cards.

4. The method of playing the matching card game of claim 1, wherein the dealing step(b) includes:

dealing each card face down.

5. The method of playing the matching card game of claim 1, further including:

at least two players.

6. The method of playing the matching card game of claim 1, further including the step of:

(e) paying out a current matchpot.

7. The method of playing the matching card game of claim 6, further including the step of:

(f) repeating step(a) through step(e) for additional matchpots.

8. The method of playing the matching card game of claim 1, wherein step(c) further includes:

(i) selecting the matching value cards in each hand of each player; and (ii) selecting the matching value cards in the hand of the dealer.

9. A method of playing a matching card game between a dealer and at least one player comprising the steps of:

(a) selecting a deck of cards, said deck of cards comprising a plurality of cards each having a face value, said deck having cards of different face values wherein there are at least two same face value cards for each face value;

(b) initially dealing a hand of cards to the at least one player and to the dealer; and (c) selecting at least once card in each player hand in an attempt to match the face value of the player selected card with face value of at least one same face value card in the dealer's hand; and (d) comparing the face value of said player selected card with the face value of a card in the dealer's hand, wherein, the at least one player having any match wins the matching card game.

10. The method of playing the matching card game of claim 9, wherein step (b) further includes: dealing five cards.

11. The method of playing the matching card game of claim 9, wherein the at least one player includes: at least two players.

12. The method of playing the matching card game of claim 9, wherein the deck further includes:

cards having a face value limited to: Ace, 2, 3, 4, 5, 6, 7, 8, 9 and 10.

13. The method of playing the matching card game of claim 12, wherein the face value cards include:

five Ace cards, five number two cards, five number three cards, five number four cards, five number five cards, five number six cards, five number seven cards, five number eight cards, and five number nine cards and five number ten cards.

14. The method of playing the matching card game of claim 9, wherein the dealing step(b) includes:

dealing each card face down.

15. The method of playing the matching card game of claim 9, wherein step(c) further includes:

(i) selecting the matching value cards in each hand of each player; and (ii) selecting the matching value cards in the hand of the dealer.

16. A method of playing a matching card game between a dealer and at least one player comprising the steps of:

(a) selecting a deck of cards, said deck of cards comprising a plurality of cards each having a face value, said deck having cards of different face values wherein there are at least two same face value cards of each face value;

(b) initially dealing a hand having at least one card to the at least one player and to the dealer; and (c) selecting the at least one card in each player hand in an attempt to match the face value of the player selected card with face value of at least one same face value card in the dealer's hand; and (d) comparing the face value of said player selected card with the face value of a card in the dealer's hand, wherein, the at least one player having any match wins the matching card game.

17. The method of playing the matching card game in claim 16, wherein the hand in step (b) further includes: at least two cards in each hand.

18. The method of playing the matching card game of claim 16, wherein the deck further includes:

cards having a face value limited to: Ace, 2, 3, 4, 5, 6, 7, 8, 9 and 10.

19. The method of playing the matching card game of claim 18, wherein the face value cards include:

five Ace cards, five number two cards, five number three cards, five number four cards, five number five cards, five number six cards, five number seven cards, five number eight cards, and five number nine cards and five number ten cards.

20. The method of playing the matching card game of claim 16, wherein the dealing step(b) includes:

dealing each card face down.

* * * * *